US009165543B1

(12) United States Patent
Vorobyev

(10) Patent No.: US 9,165,543 B1
(45) Date of Patent: Oct. 20, 2015

(54) APPARATUS, METHOD, AND COMPUTER-READABLE STORAGE MEDIUM FOR RHYTHMIC COMPOSITION OF MELODY

(71) Applicant: MIXED IN KEY LLC, Miami, FL (US)

(72) Inventor: Yakov Vorobyev, Rockville, MD (US)

(73) Assignee: MIXED IN KEY LLC, Miami, FL (US)

( * ) Notice: Subject to any disclaimer, the term of this patent is extended or adjusted under 35 U.S.C. 154(b) by 0 days.

(21) Appl. No.: 14/599,302

(22) Filed: Jan. 16, 2015

Related U.S. Application Data

(60) Provisional application No. 62/086,229, filed on Dec. 2, 2014.

(51) Int. Cl.
*G10H 1/40* (2006.01)

(52) U.S. Cl.
CPC ..... *G10H 1/40* (2013.01)

(58) Field of Classification Search
USPC ..... 84/611
See application file for complete search history.

(56) References Cited

U.S. PATENT DOCUMENTS

| | | | | |
|---|---|---|---|---|
| 5,684,259 | A * | 11/1997 | Horii | 84/600 |
| 6,124,543 | A * | 9/2000 | Aoki | 84/609 |
| 6,281,421 | B1 * | 8/2001 | Kawaguchi | 84/603 |
| 6,294,720 | B1 * | 9/2001 | Aoki | 84/611 |
| 2006/0075886 | A1 * | 4/2006 | Cremer et al. | 84/635 |
| 2008/0295674 | A1 * | 12/2008 | Rosario et al. | 84/635 |
| 2015/0013527 | A1 * | 1/2015 | Buskies et al. | 84/611 |

* cited by examiner

*Primary Examiner* — Christopher Uhlir
(74) *Attorney, Agent, or Firm* — Oblon, McClelland, Maier & Neustadt, L.L.P.

(57) ABSTRACT

A method and apparatus for musical rhythmic composition. The method includes receiving a selection of a rhythmic template out of a plurality of available rhythmic templates, each of the plurality of rhythmic templates corresponding to a musical genre, and generating an irregular grid corresponding to the selected rhythmic template, the irregular grid including a plurality of blocks arranged side by side, at least one block of the plurality of blocks being irregularly spaced with respect to other blocks, each of the plurality of blocks representing a particular position at which a musical note is insertable to be in-rhythm with the corresponding musical genre of the selected rhythmic template.

17 Claims, 8 Drawing Sheets

APPARATUS, METHOD, AND COMPUTER-READABLE STORAGE MEDIUM FOR RHYTHMIC COMPOSITION OF MELODY

CROSS-REFERENCE TO RELATED APPLICATIONS

This application claims the benefit of the earlier filing date of and incorporates by reference the entirety of U.S. Provisional Application No. 62/086,229, filed Dec. 2, 2014.

BACKGROUND

1. Field

Embodiments described herein relate to composing a melody or song.

2. Background

When composing a song, it is challenging to determine where to add notes and where to leave empty space between notes. This process is simplified by applying a rhythm to the melody. Rhythm is defined as "movement marked by the regulated succession of strong and weak elements."

Playing notes on a piano, guitar, keyboard, or the like usually requires the musician to adhere to a specific rhythm, such as playing a note on every beat, playing a note on every other beat, etc. Adherence to the rhythm is important because playing a note at the wrong time will violate the rhythm of the song and will result in an unpleasant sound (the song will sound incorrect/off-beat, like the musician made a mistake), while playing on the rhythm would typically result in "expected" and pleasant timing (the song will sound correct/on-beat).

Typically, Digital Audio Workstations (DAWs) (such as, Ableton® Live, Apple® Logic, GarageBand®, FruityLoops, Pro Tools®, and the like) create uniform grids by dividing a measure into beats and beats into smaller sections, and display these grids to help guide a user as to where in the grid to insert a note "correctly" in relation to the beat. When preforming the aforementioned division, these DAWs assume that a given melody or song is regular (i.e., has a regular beat or rhythm throughout). As a result, in those DAWs, the distance between blocks is always uniform.

However, the majority of today's popular music does not follow a uniform rhythm. Even songs that have a regular repetitive pattern (for example, a Pop, Electro/Dance, or Hip-Hop song) may have instruments that play irregular rhythms, such as a bass guitar. Furthermore, there are certain musical genres that contain more irregular rhythms than other genres (for example, Reggae, Jazz, Funk, etc.). For example, a modern 2014 hit song called "Rude" by the band called "Magic!" follows a similar rhythm to any traditional Reggae track, and thus can be identified as a Reggae song simply by listening to its rhythm.

When composing such music, a musician who follows the uniform grid division provided by these DAWs, may incorrectly insert notes in parts of the song that violate the rhythm. This results in a composition that is out of rhythm and hence does not sound pleasant.

BRIEF DESCRIPTION OF THE DRAWINGS

The disclosure will be better understood from reading the description which follows and from examining the accompanying figures. These figures are provided solely as non-limiting examples of the embodiments. In the drawings.

DETAILED DESCRIPTION

Figure 1:
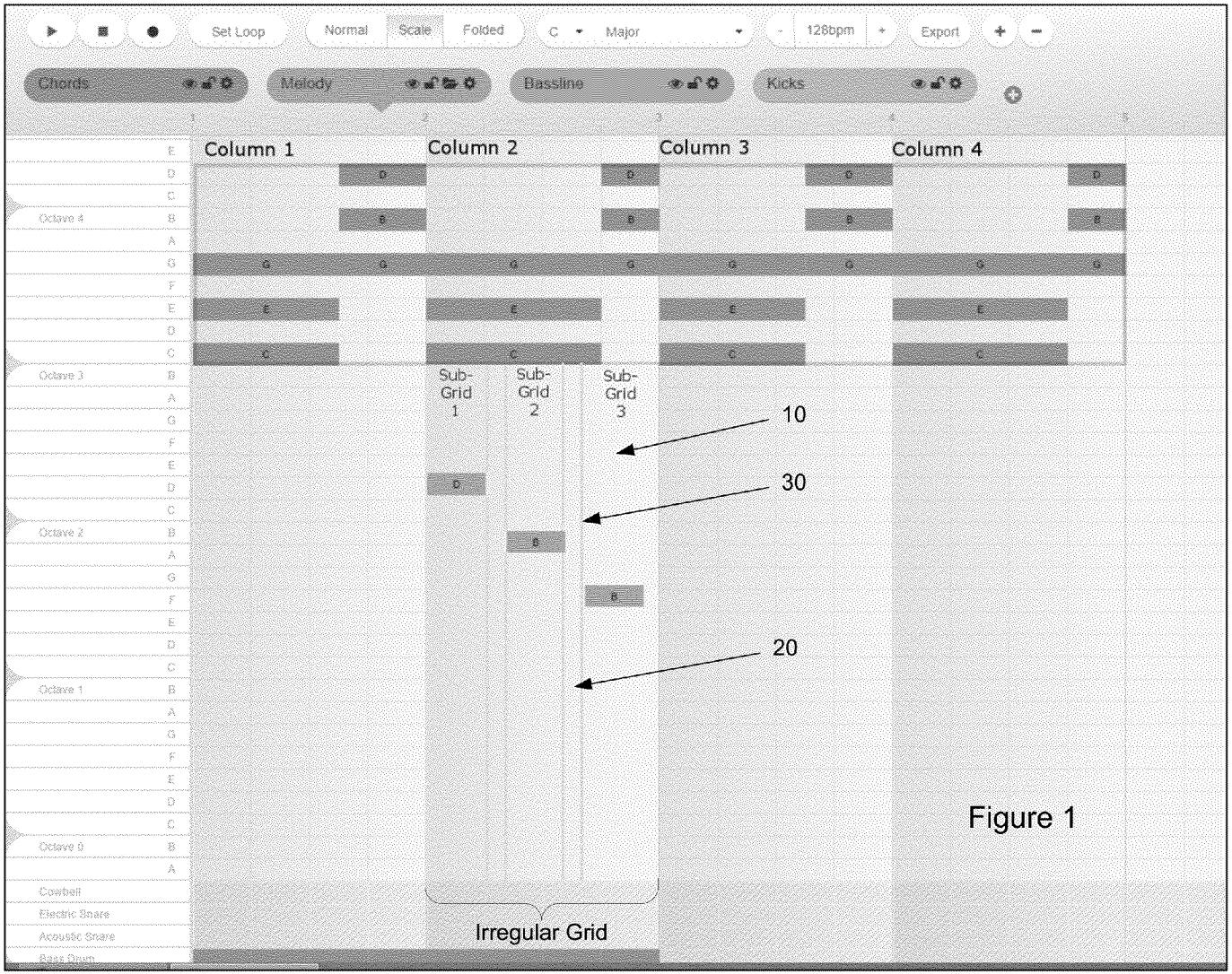
FIG. 1 illustrates a screen for visualizing a melody.

One embodiment of the present disclosure is drawn to a method for musical rhythmic composition. The method comprises receiving a selection of a rhythmic template out of a plurality of available rhythmic templates, each of the plurality of rhythmic templates corresponding to a musical genre; displaying, on a display device, an irregular musical grid corresponding to the selected rhythmic template, the irregular grid including a plurality of blocks arranged side by side, at least one block of the plurality of blocks being irregularly spaced with respect to other blocks, each of the plurality of blocks representing a particular position at which a musical note is insertable to be in-rhythm with the corresponding musical genre of the selected rhythmic template; receiving a designation of a block of the plurality of blocks in which to insert a musical note; and displaying a visual representation of the musical note in the designated block.

In one embodiment, the method further comprises displaying, on the display device, a visual indication on the irregular musical grid distinguishing important parts of the rhythmic template from less important parts.

In one embodiment, the method further comprises receiving the musical note from an external musical instrument.

In one embodiment, the method further comprises displaying, on the display device, a warning that a musical note is out of rhythm, in response to designating an area in between two adjacent blocks of the plurality of blocks in which to insert the musical note.

In one embodiment, the irregular grid includes a plurality of blocks irregularly spaced with respect to other blocks.

One embodiment of the present disclosure is drawn to an apparatus for musical rhythmic composition. The apparatus comprises processing circuitry programmed to implement the musical rhythmic composition, the processing circuitry being configured to receive a selection of a rhythmic template out of a plurality of available rhythmic templates, each of the plurality of rhythmic templates corresponding to a musical genre, display an irregular grid corresponding to the selected rhythmic template, the irregular grid including a plurality of blocks arranged side by side, at least one block of the plurality of blocks being irregularly spaced with respect to other blocks, each of the plurality of blocks representing a particular position at which a musical note is insertable to be in-rhythm with the corresponding musical genre of the selected rhythmic template, receive a designation of a block of the plurality of blocks in which to insert a musical note, and display a visual representation of the musical note in the designated block.

In one embodiment, the processing circuitry is further configured to display a visual indication on the irregular musical grid distinguishing important parts of the rhythmic template from less important parts.

In one embodiment, the processing circuitry is further configured to receive the musical note from an external musical instrument.

In one embodiment, the processing circuitry is further configured to display a warning that a musical note is out of rhythm, in response to designating an area in between two adjacent blocks of the plurality of blocks in which to insert the musical note.

In one embodiment, the irregular grid includes a plurality of blocks irregularly spaced with respect to other blocks.

One embodiment of the present disclosure is drawn to a method for musical rhythmic composition. The method comprises receiving a selection of a rhythmic template out of a plurality of available rhythmic templates, each of the plurality of rhythmic templates corresponding to a musical genre; and generating an irregular grid corresponding to the selected rhythmic template, the irregular grid including a plurality of blocks arranged side by side, at least one block of the plurality of blocks being irregularly spaced with respect to other blocks, each of the plurality of blocks representing a particular position at which a musical note is insertable to be in-rhythm with the corresponding musical genre of the selected rhythmic template.

One embodiment of the present disclosure is drawn to a non-transitory computer-readable storage medium including computer executable instructions, wherein the instructions, when executed by a computer, cause the computer to perform a method for rhythmic composition of a melody, the method comprising receiving a selection of a rhythmic template out of a plurality of available rhythmic templates, each of the plurality of rhythmic templates corresponding to a musical genre; displaying, on a display device, an irregular musical grid corresponding to the selected rhythmic template, the irregular grid including a plurality of blocks arranged side by side, at least one block of the plurality of blocks being irregularly spaced with respect to other blocks, each of the plurality of blocks representing a particular position at which a musical note is insertable to be in-rhythm with the corresponding musical genre of the selected rhythmic template; receiving a designation of a block of the plurality of blocks in which to insert a musical note; and displaying a visual representation of the musical note in the designated block.

In one embodiment, the non-transitory computer-readable storage medium further comprises displaying, on the display device, a visual indication on the irregular musical grid distinguishing important parts of the rhythmic template from less important parts.

In one embodiment, the non-transitory computer-readable storage medium further comprises receiving the musical note from an external musical instrument.

In one embodiment, the non-transitory computer-readable storage medium further comprises displaying, on the display device, a warning that a musical note is out of rhythm, in response to designating an area in between two adjacent blocks of the plurality of blocks in which to insert the musical note.

In one embodiment, the irregular grid includes a plurality of blocks irregularly spaced with respect to other blocks.

In one embodiment, one way to address the above-discussed drawback is to provide a visual guide for the user that more accurately and precisely illustrates where a note may be inserted in a song to be in-rhythm. Inserting a note in places not indicated by such visual guide would violate the rhythm. As such, the user can easily and accurately determine where he or she may insert a particular note in a particular melody or song.

FIG. 1 illustrates a screen for visualizing a melody. As shown in FIG. 1, the first, third, and fourth columns have regular grids that divide each column into equally-sized blocks, as is typically the case in DAWs.

However, according to one embodiment, the second column illustrates an irregular grid, which includes irregularly spaced sub-grids (having blocks therein) (a pattern that does not have uniform spaces between blocks). As illustrated in FIG. 1, the irregular grid includes sub-grids (sub-grid #1, sub-grid #2, and sub-grid #3 in FIG. 1), arranged side by side. Each sub-grid includes blocks 10. Blocks 10 of different sub-grids are arranged side by side (left to right, in a row fashion).

Each row corresponds to notes of an octave. Each sub-grid represents the maximum length for a note playing in-rhythm. Notes can be shorter or longer, but would typically not exceed the length of the given sub-grid.

Note that, in one embodiment, the space between sub-grid #1 (and the blocks 10 therein) and sub-grid #2 (and the blocks 10 therein) may be different than sub-grid #2 (and the blocks 10 therein) and sub-grid #3 (and the blocks 10 therein). In one embodiment, an irregular grid may include one or more sub-grids/blocks that are irregularly spaced with respect to other sub-grids/blocks. In one embodiment, every block 10 may have a different spacing 20 with respect to the other blocks 10 of the irregular grid. In one embodiment, there may be one or more blocks 10 that include no spacings with respect to adjacent blocks 10, while other block(s) 10 may include spacings 20. Thus, there may be any combination of spacings 20 between blocks 10. Note that the aforementioned spacings 20 are distinguished by the vertical lines 30 extending through the length of the sub-grids.

The user has a choice of irregular grids that describe different feelings of the melody. For example, the user may be presented with a list of 100 possible rhythm/rhythmic templates that are popular in music. Each of these rhythms may be labelled with a descriptive text such as "Reggae Rhythm #1", "Classic Hip-Hop", etc.

Professional musicians may be able to create those templates by listening to popular music, and by hearing where the notes change in relation to the underlying measure/beat structure. In one embodiment, to accurately describe the position of each vertical line 30 in a rhythm, a language based on the Beat position may be used. Each beat can be sub-divided into 8 smaller locations. To specify the position, the notation in Table 1 below may be used, expanding on the common '1 e A a' notation:

TABLE 1

| Name | Location |
|---|---|
| 1 | beat 1 0 |
| 1+ | beat 1 + 1/32 |
| 1e | beat 1e |
| 1e+ | beat 1e + 1/32 |
| 1& | beat 1& (and) |
| 1&+ | beat 1& + 1/32 |
| 1a | beat 1a |
| 1a+ | beat 1a + 1/32 |

The aforementioned locations can be specified in milliseconds, or any other format that indicates time. Note that Table 1 is for exemplary purposes only and is an over-simplification that does not allow super-precise placement of notes.

Assume, for example, a song at a 120 beats-per-minute (BPM) rate. In this case, the distance between beat 1 and 2 will be 500 milliseconds. If 500 milliseconds is divided into $1/32^{nd}$, the minimum "resolution" will be around 15.625 milliseconds. Note that there may be cases where a finer resolution may be needed. For example, typical MIDI protocol supports resolution up to $1/64^{th}$.

Accordingly, a finer precision than what is defined in Table 1 may be needed. In such case, $1/64^{th}$ grid division may be used, or even smaller division based on milliseconds as a unit of measurement.

In one embodiment, the numbering can start at beat 1 and continue up to 4, 8, or however long is needed for a loop. A loop is defined as a short unit of the melodic composition that repeats itself. A typical loop may contain just 8 beats, and the same theme repeats again. A sample description of the rhythm may be: "1, 2&, 4", which means that the rhythm allows a musical note to be played at on Beat 1, on Beat 2&, and on Beat 4. Absence of other positions in this rhythm means that all other note positions would be invalid for this rhythm, and may not be played by the musician.

In one embodiment, the musician may change the feeling of his or her composition from a Pop Singer/Songwriter piece to a Reggae piece by changing one section of the song to use a Reggae rhythm, and by adjusting the notes to fit the provided Reggae rhythm. This will provide the instant feeling of Reggae while maintaining the same melodic and harmonic feeling in the song.

As discussed above, the irregular grid illustrated in the second column of FIG. 1 allows a user to visualize where a particular note can be inserted. If the note is not inserted where the irregular grid indicates, the rhythm of that particular song would be violated. As an example, if a note is inserted between the first set of vertical lines 30 (i.e., in the spacing 20 between the blocks 10), the rhythm would be violated. In one embodiment, an insertion of a note in the spacing 20 between the blocks 10 may not be allowed. For example, if an attempt is made to insert a note in an out of rhythm area, a pop-up dialog box may be displayed indicating to the user that the note cannot be placed in the selected area as this would violate the rhythm the user is trying to achieve.

In one embodiment, an insertion of a note in the spacing 20 between the blocks 10 may be allowed, although the note would not be in-rhythm. However, in such case, the note would be visually represented in a distinguishing manner (from the in-rhythm notes) to warn the user that the note is placed in an area that would violate the rhythm. For example, the visual representation of the note that is placed in an area that violates the rhythm may be in red, whereas a visual representation of a note that is placed in an area that is in-rhythm may be displayed in green.

In one embodiment, if the note is placed in an area that would violate the rhythm, a pop-up dialog box may be displayed warning the user that placing the note in such area would violate the rhythm.

As an example, assume a user would like to produce a Reggae song and would like to include a piano portion within the song. The irregular grid associated with Reggae would be displayed to the user (similar to the second column in FIG. 1). The user can then visualize the correct parts of the song in which to insert the piano portion in order to produce an in-rhythm Reggae song.

As another example, assume the user would like to include the same piano portion into a Jazz song. The irregular grid associated with a specific Jazz rhythm would be displayed to the user, and then the user can visualize the correct note positions in which to insert the piano instrument in order to produce an in-rhythm Jazz song.

Although the pitch of piano notes may be the same between two or more compositions, the feeling of the song will change dramatically as a result of a different rhythm. It is possible to achieve different moods through the use of rhythms, from laid-back and relaxed, to upbeat and energetic. When working on a song, the musician is likely to go through different rhythms to find one that offers the correct balance of complexity and mood to fit the composition. By being able to visualize the rhythm on a display (such as a display/computer screen), the musician will be able to see the complexity of the rhythm without having to hear it. This approach to visualizing rhythms is a useful shortcut for faster and more accurate melodic composition.

Figure 2:
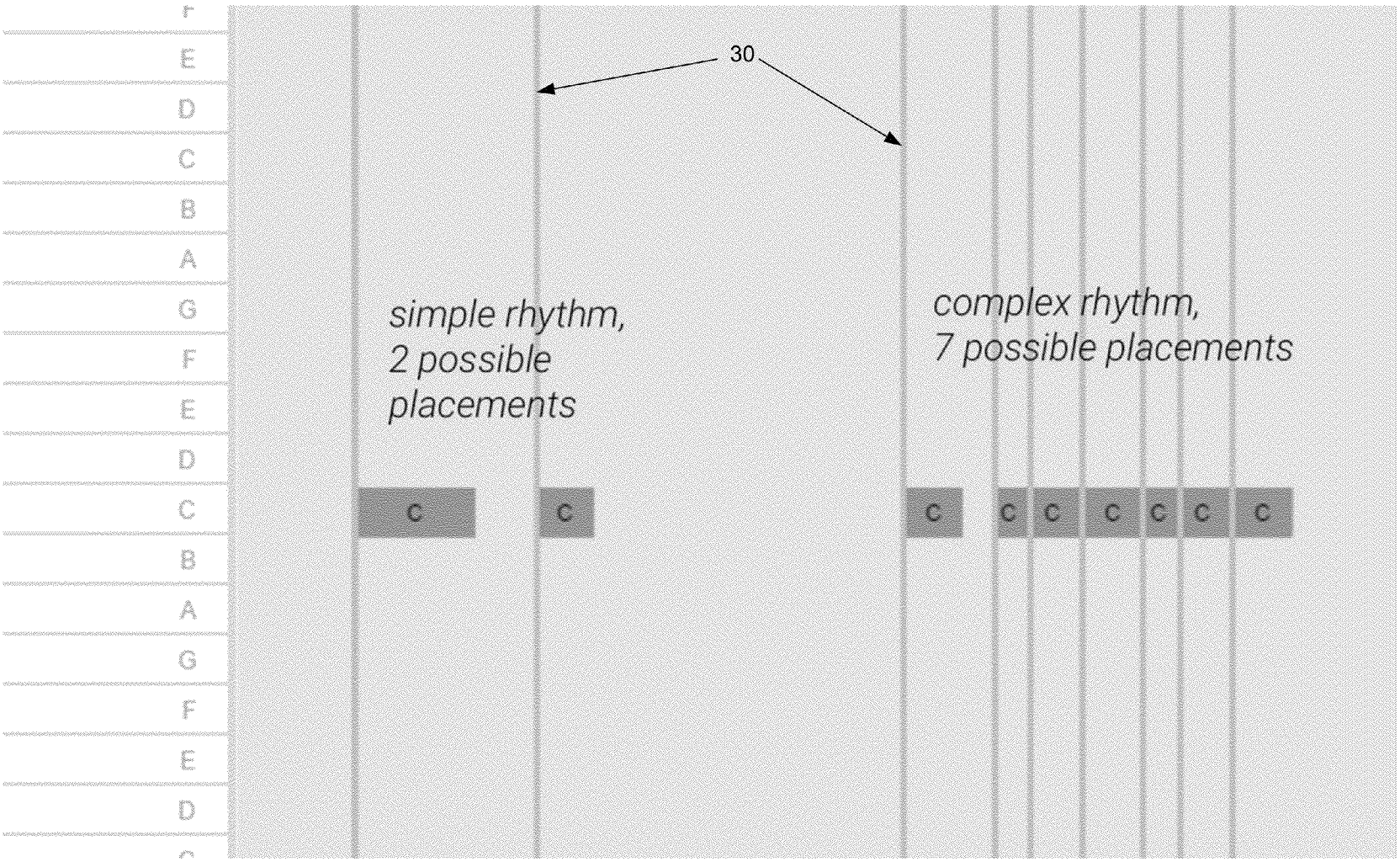
FIG. 2 illustrates the difference between a simple and a complex rhythm.

FIG. 2 shows the difference between a simple and a complex rhythm. Complex rhythm contains more irregularly-spaced lines 30 (or blocks 10), and is more densely packed. A simple rhythm contains only 2 vertical lines 30 (or blocks 10) indicating the two possible places where the musician can play any note.

Accordingly, as long as the user follows the visual cues given by the irregular grid (shown in the second column in FIG. 1), the user is able to insert one or more notes into a song regardless of the genre or type of song while maintaining proper rhythm.

In one embodiment, the irregular grid may be drawn using thicker vertical lines 30 to indicate more important parts of the rhythm and thinner lines to indicate less important parts of the rhythm. Note that recognizing and using important and less important beats correctly is critical to music production. For example, notes on the important beats should be at frequencies that help establish the tonal center of the song, while less important beats should contain frequencies that lead into adjacent notes.

The approach of indicating important and less important parts of the rhythm benefits the user because it shows which sections of the rhythm are, for example, essential to maintaining the dance-ability and recognition of the rhythm as a "Reggae" rhythm, and which sections are optional and used to add extra ornamentation to the main elements of the rhythm.

Figure 3:
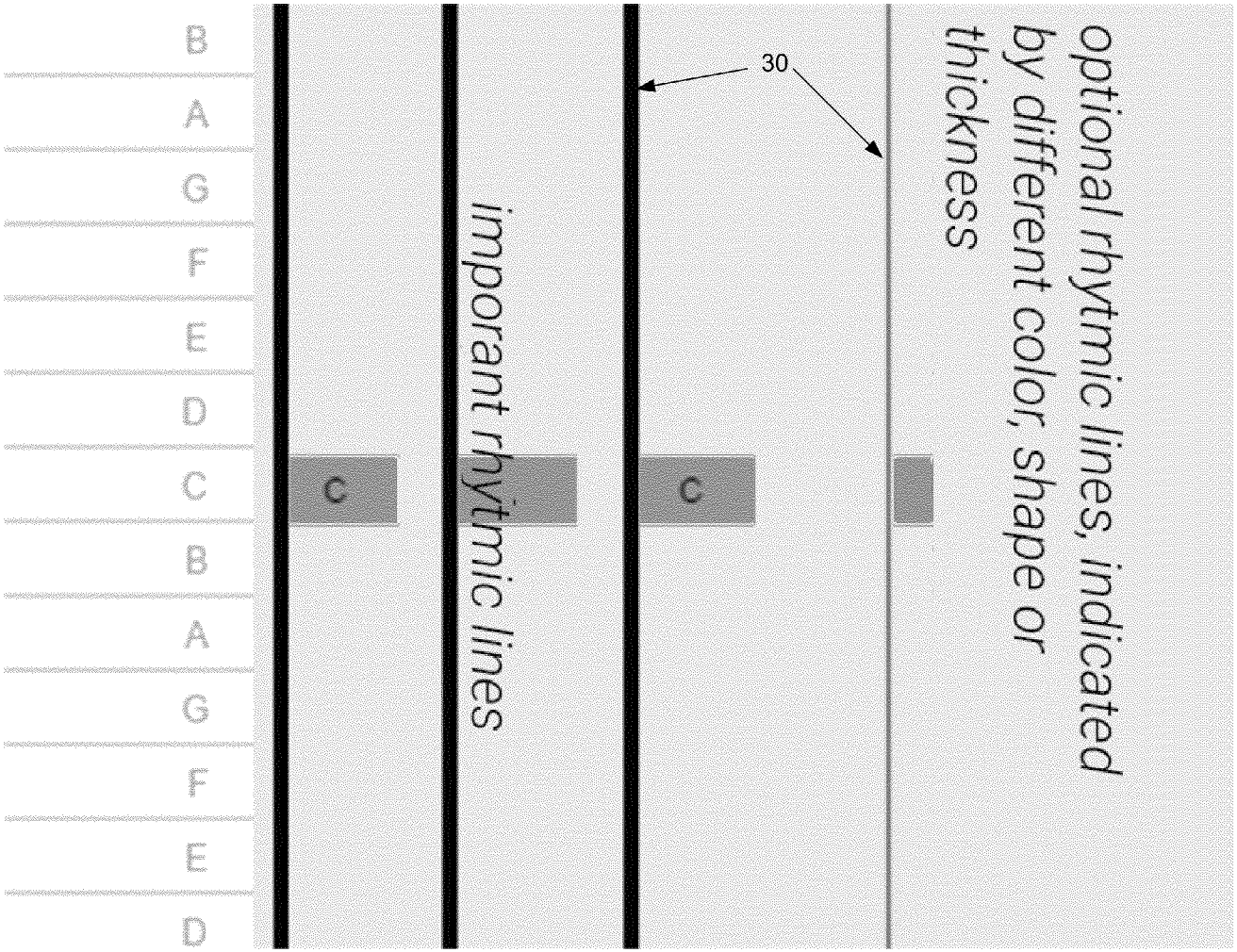
FIG. 3 illustrates important and optional rhythmic lines.

In one embodiment, the irregular grid may be generated using different colors to differentiate between more important parts of the rhythm and less important parts of the rhythm. FIG. 3 shows an example of a rhythm where the important elements occur on every beat, but there is an optional musical ornament added between beat #4 and beat #5.

The concept of quantization in music processing is to provide a more beat-accurate timing of notes or sounds. Quantizing generally refers to snapping notes to a grid (for example, the equally-sized grid shown in the first, third, and fourth columns in FIG. 1). However, if quantization is applied to the equally-sized grids, the notes may be incorrectly snapped to the grid without any regard to the underlying rhythm, which is likely to be different from the standard uniform grid shown in all DAWs. As noted above, this would result in a piece that is out of rhythm and hence sounds offbeat and incorrect.

To address this issue, in one embodiment, the irregular grid may be used to snap notes to the irregular grid (quantize-to-rhythm). Thus, when recording, for example, a keyboardist playing live, the played notes will automatically snap to the irregular grid (to the blocks 10 in the irregular grid). This would result in a can't-fail example of playing a certain rhythm while forgiving the keyboardist's mistakes of timing, since all notes will play on the rhythm.

To summarize, grids in DAWs (such as the grids shown in the first, third, and fourth columns in FIG. 1) always assume a regular pattern of beats and sub-beats that conform to the selected time signature and tempo of the song, with all possible beat locations at a specified resolution being equidistant from each other. By contrast, one embodiment discussed herein includes irregular grids, which do not have regular patterns. In one embodiment, these grids are generated in advance and stored as preset rhythmic templates. As detailed herein, a user/musician is able to select a rhythmic template (for example, a "Classic Reggae" template) and use it to compose a melody corresponding to such rhythm (for example, a "Classic Reggae" song).

In one embodiment, irregular grids are created that are specific to one point of inspiration, such as an old 1970s Funk song, or an old Bob Marley record in the style of Reggae. Although there may be thousands of possible rhythms in the world, the same common ones are used over and over. Thus, in one embodiment, there may be 150 common rhythms.

Figure 4:
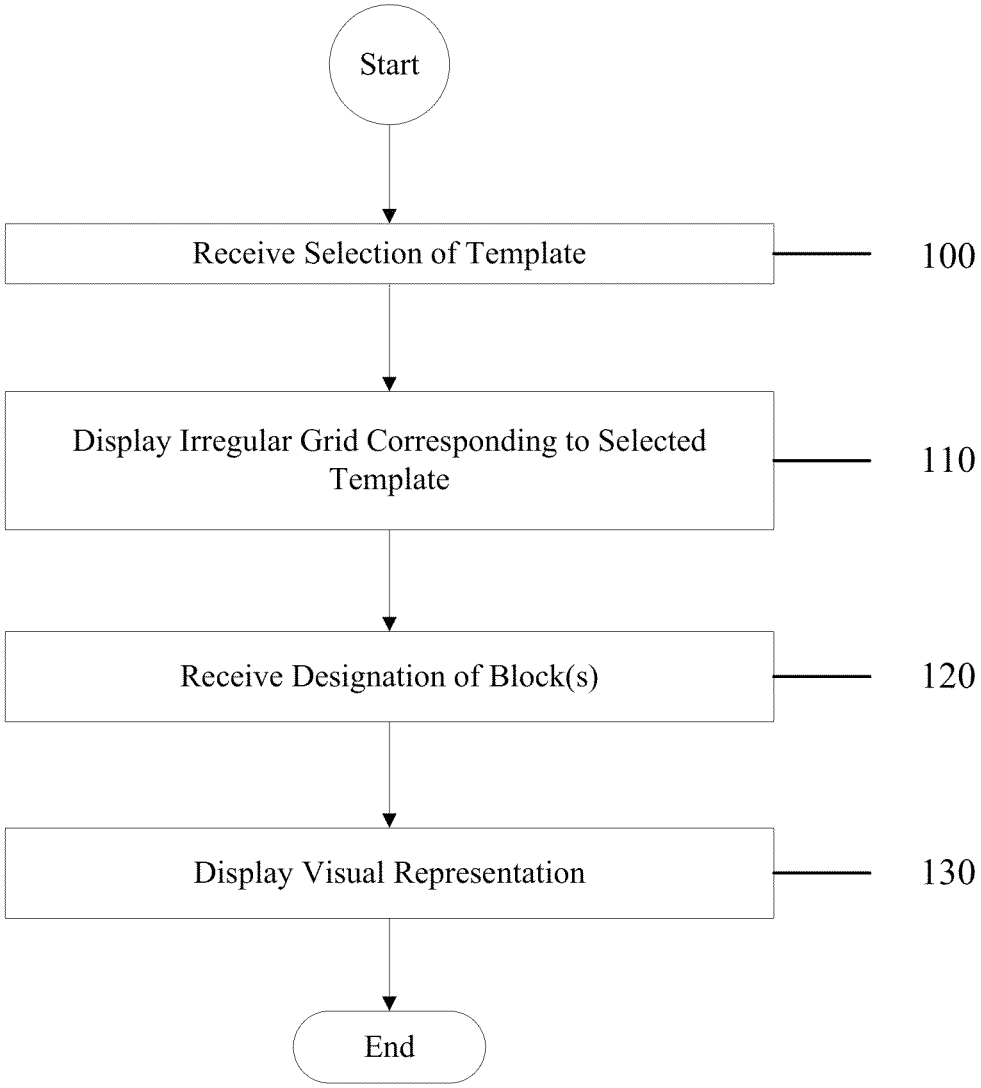
FIG. 4 is a flowchart of a process of one embodiment of the present disclosure.

FIG. 4 is a flowchart of a process of one embodiment of the present disclosure. The process of FIG. 4 is performed by a device, such as the device discussed with respect to FIG. 8.

As discussed above, the musician/user may select a template for a particular rhythm (in other words, a preset rhythm such as, for example, Reggae Rhythm #1) out of a plurality of different templates (for example, 150 templates). This selection may be performed via an input device. Thus, at step 100, the selection of the rhythmic template is received by the device. As noted above, the templates may have been previously generated and stored in a storage device (i.e., a memory, hard disk drive (HDD), database, cloud, etc.).

In one embodiment, the musician may select a particular template when he or she is interested in creating an entire song with that corresponding rhythm (for example, an entire Reggae song). In one embodiment, the musician may select the particular template when he or she is interested in inserting a section with such corresponding rhythm into a portion of a song.

For example, the musician may wish to compose an Electro/Dance song. Within this Electro/Dance song, the musician may wish to include a portion that is of a different rhythm (or musical genre) (for example, the musician may wish to insert a Reggae portion within the Electro/Dance song). One example where such portion may be inserted is at a breakdown in the Electro/Dance song (a portion of the song that does not contain the repetitive drum beat). This portion may be relatively short (for example, 20-30 seconds out of a 4 minute song). This would enhance the song and provide a fresh twist on what may otherwise be a typical Electro/Dance song.

In one embodiment, the musician may select a particular template when he or she is interested in remixing an existing song. A remix is a new or different version of a song that is made by changing or adding to the original recording of the song. Thus, the musician may be interested in changing an original Jazz song into a Reggae song. In such case, the musician would select a template such as Reggae Rhythm #1.

After receiving the selection performed, at step 100, the corresponding irregular grid (for example, as shown in the second column of FIG. 1) is displayed by the device, at step 110, on the display to help the musician visualize where to insert notes. As discussed above, the irregular grid includes a plurality of blocks arranged side by side. At least one block of the blocks is irregularly spaced with respect to other blocks. Further, each of the blocks represents a particular portion in which a musical note is insertable to be in-rhythm with the corresponding rhythm/musical genre of the selected rhythmic template.

Assuming, for example, the musician would like to insert the Reggae portion within the Electro/Dance song, as noted above, he or she can now visualize where to insert certain notes in the Electro/Dance song to achieve the feel of Reggae. Thus, at step 120, the device receives a designation of a block and/or blocks 10 of the irregular grid where a note is/notes are to be inserted. The musician may choose to insert, for example, keyboard notes, guitar notes, etc. into the block and/or blocks 10 designated by the irregular grid.

Next, at step 130, the device displays a visual representation of the note(s) inserted into the respective block(s) 10. In one embodiment, this may be visualized by solid boxes shown in the second column of FIG. 1 (i.e., box D, box B, and box B corresponding to a block 10 in sub-grid #1, a block 10 in sub-grid #2, and a block10 in sub-grid #3, respectively). In one embodiment, these solid boxes may be displayed in the color green to indicate to the musician that these notes are correctly placed so as to be in-rhythm.

After the desired notes have been inserted and the musician is satisfied with the musical composition, the composition may be finalized. In one embodiment, this may include fine-tuning the composition, which may include adjusting the volume, equalizer, etc. In one embodiment, this may include filtering, normalizing, etc., the composition. In one embodiment, this may include saving the composition as an MP3 file, a WAV file, or the like.

In one embodiment, the musician/user may generate his or her own template (irregular grid) based on a particular rhythm he or she is trying to achieve. In one embodiment, this may be achieved using the notation shown above in Table 1. This generated template may then be stored in a memory/database along with the other default templates (for example, the 150 templates that have been previously created).

Figure 5:
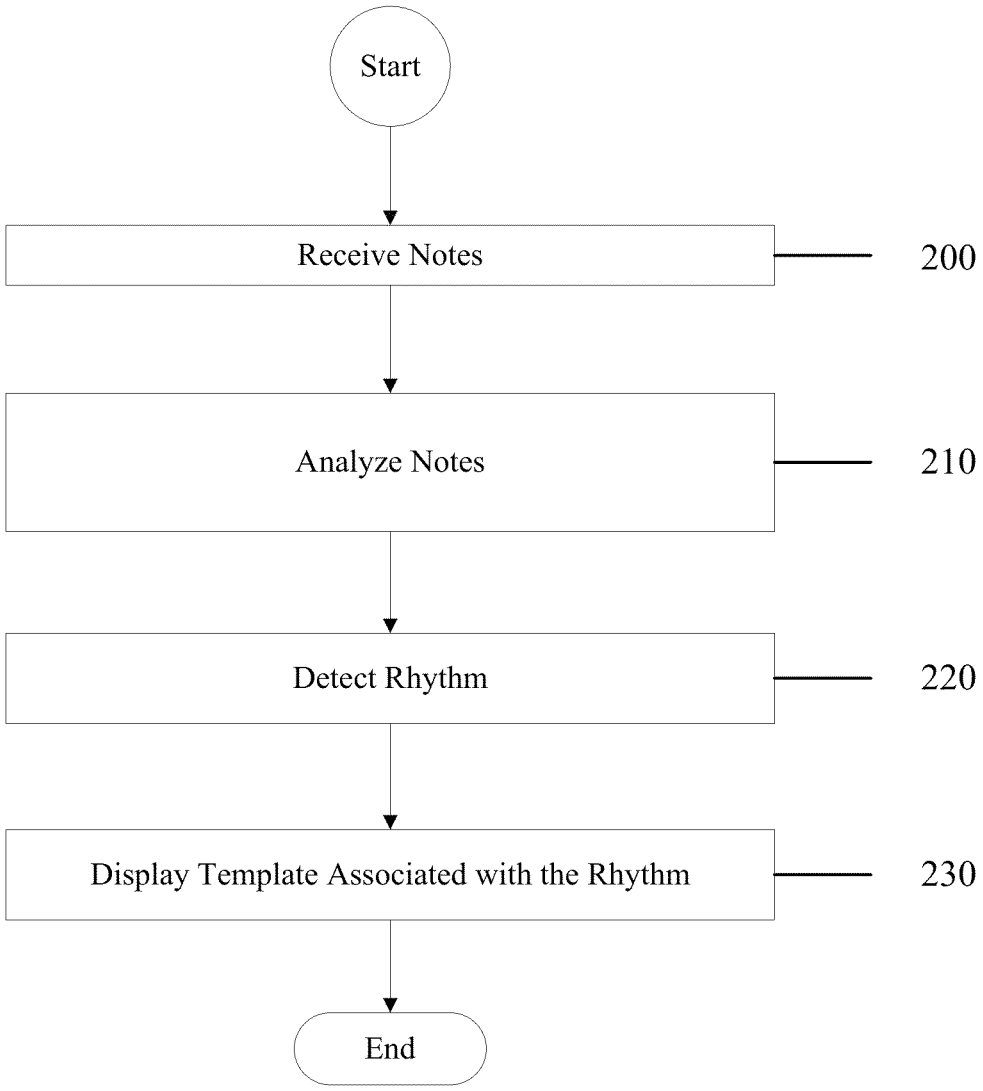
FIG. 5 is a flowchart of a process of one embodiment of the present disclosure.

FIG. 5 is a flowchart of a process of one embodiment of the present disclosure. The process of FIG. 5 is performed by a device, such as the device discussed with respect to FIG. 8. In this embodiment, the type of rhythm that is being played can be automatically detected and a template matching that rhythm can be automatically selected.

At step 200 of FIG. 5, the device receives notes. In one embodiment, these notes may be played live via an instrument. For example, a keyboardist may play the notes. Next, at step 210, the device analyzes these notes. In one embodiment, these notes are analyzed to determine the way they are played by the musician (timing, style, sequence, velocity, etc.). Velocity is a musical term for volume (i.e., how hard a note is played by the musician). For example, if a musician pushes a piano note softly, it will sound different than if he or she plays the note really hard.

At step 220, the device detects the rhythm being played. In one embodiment, this may be achieved after a number of predetermined notes are played (to detect timing, for example). For example, at this step, the device may determine that the timing, style, sequence, and/or velocity of notes resemble a Reggae rhythm. As such, the device may compare this detected rhythm with the templates already stored (for example, the 150 templates noted above).

Assuming that a match is found, the device then displays, at step 230, the corresponding template that is associated with the rhythm being played.

To summarize the embodiment discussed with reference to FIG. 5, the type of rhythm that is being played can be automatically detected and a template matching that rhythm can be automatically selected. For example, a keyboardist may play particular notes live. Based on the way the keyboardist plays the notes (the timing, style, sequence, velocity, etc.), it may be determined that he or she is likely playing a Reggae rhythm. Based on this determination, the Reggae Rhythm #1 template may be automatically selected and displayed for the keyboardist. This may be selected without additional input from the user/keyboardist.

Figure 6:
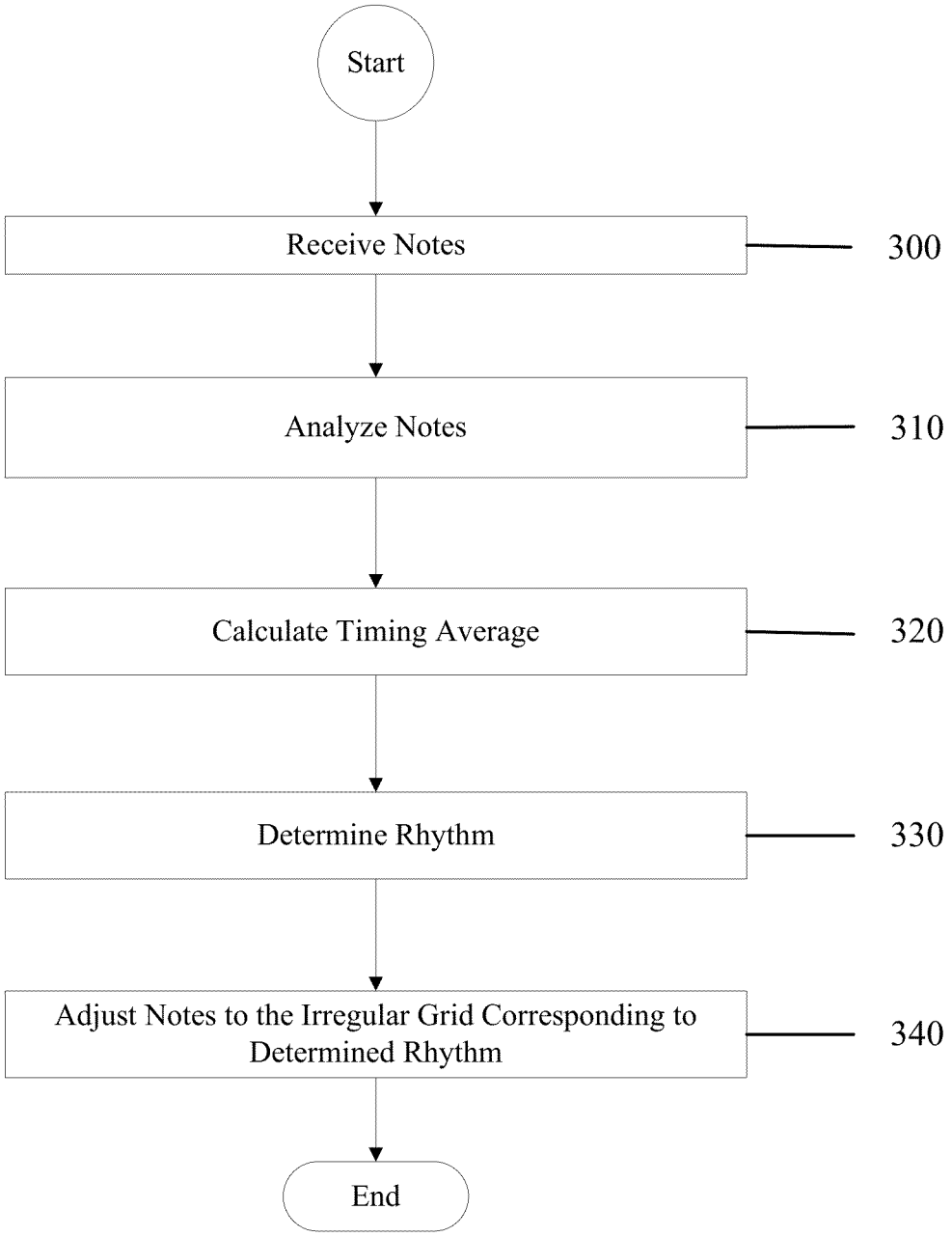
FIG. 6 is a flowchart of a process of one embodiment of the present disclosure.

FIG. 6 is a flowchart of a process of one embodiment of the present disclosure. The process of FIG. 6 is performed by a device, such as the device discussed with respect, to FIG. 8. In this embodiment, notes played live by a keyboardist can be analyzed and automatically adjusted to fit the overall rhythm the keyboardist is trying to achieve.

At step 300, the device receives notes. In one embodiment, these notes may be played live via an instrument. For example, a keyboardist may play the notes. Next, at step 310, the device analyzes these notes. In one embodiment, these notes are analyzed to determine the way they are played by the musician (timing, style, sequence, velocity, etc.).

At step 320, the device calculates a timing average of the received notes to determine the most-likely rhythm the keyboardist is trying to achieve. In one embodiment, the timing average may be calculated after a predetermined time (for example, 10 seconds) has passed. In one embodiment, the timing average may be calculated at a plurality of predetermined times (for example, every 10 seconds). For example, the keyboardist may play a particular set of notes numerous times.

At step 330, the device determines the rhythm the keyboardist is likely trying to achieve. For example, the device may determine that the keyboardist is trying to play a Reggae rhythm. In particular, the device may determine that the keyboardist is likely playing a rhythm corresponding to the previously stored Reggae Rhythm #1 template. Next, at step 340, the played notes may be adjusted (or snapped) to the irregular grid of the determined rhythm (for example, Reggae Rhythm #1). As a further step, the device may also display the irregular grid corresponding to the determined rhythm and visually indicate a comparison between the originally played notes and the notes that have been adjusted to fit the irregular grid.

The embodiment discussed with respect to FIG. 6 may be useful in accounting for a keyboardist's mistake of timing when attempting to achieve a specific rhythm. Thus, at first, the keyboardist's timing may be off between the played notes. However, after the process of FIG. 6 is performed (which may be performed continuously throughout the entire time the keyboardist is playing), the notes will be automatically adjusted to achieve the rhythm the keyboard wishes to achieve. As a result, the rhythm will sound like a Reggae rhythm, even though the keyboardist may not be in the Reggae rhythm when playing the notes.

To summarize the embodiment discussed with reference to FIG. 6, played notes may be analyzed and automatically adjusted to fit the overall rhythm the keyboardist is trying to achieve. For example, the keyboardist may play a particular set of notes numerous times. However, the timing of the set of notes may differ each time it is played due to the keyboardist's mistake. Accordingly, to account for such mistake, the played notes may be analyzed and a timing average may be computed to determine the most-likely rhythm the keyboardist is trying to achieve. For example, based on this analysis it may be determined that the keyboardist is likely trying to play a Reggae rhythm. The played notes may then be adjusted (or snapped) to the irregular grid of the determined rhythm (for example, Reggae).

Figure 7:
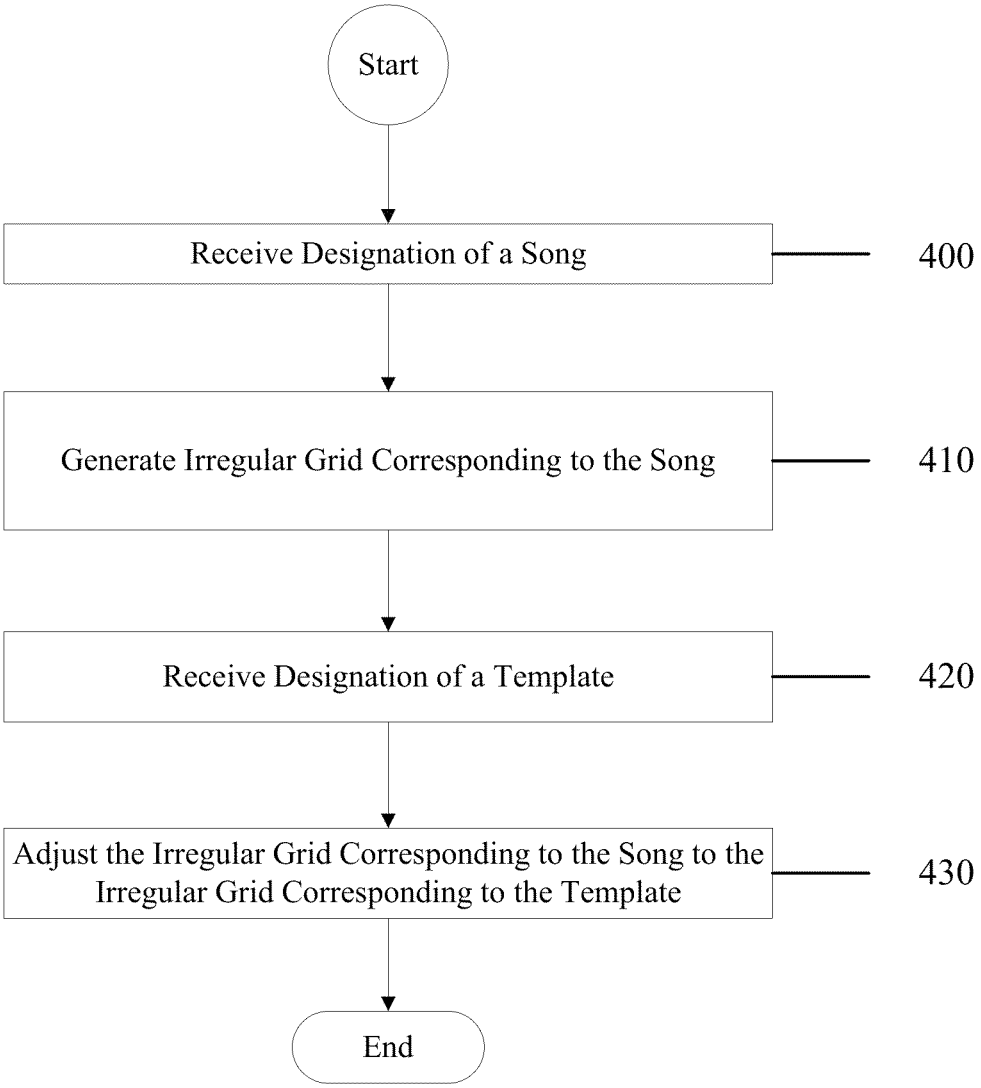
FIG. 7 is a flowchart of a process of one embodiment of the present disclosure.

FIG. 7 is a flowchart of a process of one embodiment of the present disclosure. The process of FIG. 7 is performed by a device, such as the device discussed with respect to FIG. 8. In this embodiment, the device can automatically analyze (map) a song and then convert it to another musical genre (i.e., automatically create a remix).

At step 400, the device receives designation of a song. This selection may be performed via an input device. Once the song has been selected, the device generates an irregular grid corresponding to the selected song, at step 410. This can be accomplished by analyzing the beat, tempo, timing, style, and/or velocity of notes.

At step 420, the device receives a designation of a template. This template corresponds to the rhythm the user is trying to convert the original song to. Thus, the rhythm of the original song will likely be different than the rhythm corresponding to the designated template.

Next, once a template has been designated, the device, at step 430, adjusts the irregular grid corresponding to the song (designated at step 400) to the irregular grid corresponding to the template (designated at step 420). In other words, the device transforms the original 'layout' of the song to the new 'layout' corresponding to the selected template. Thus, in effect, the device can automatically create a remix of the original song.

For example, Rude by Magic! may be mapped out resulting in an irregular grid with corresponding notes therein. From there, a user can simply select a template (for example, Jazz), and the system can automatically adjust the various notes from the original version of Rude to fit the Jazz template, thereby creating a Jazz version of the original Rude version.

Although the above-discussed embodiments include various references to "Reggae" and "Jazz," it is to be understood that these serve only as examples. Thus, the aforementioned embodiments can be applied to any type of musical genre or rhythm.

The embodiments discussed herein may be used both for live performance and for drawing notes (for example, with a keyboard and mouse).

The embodiments discussed herein may be used with Musical Instrument Digital Interface (MIDI)-type devices. In one embodiment, the musical composition/song created by the user may be in a MIDI format. In one embodiment, the musical composition/song created by the user may be exported to any DAW.

Figure 8:
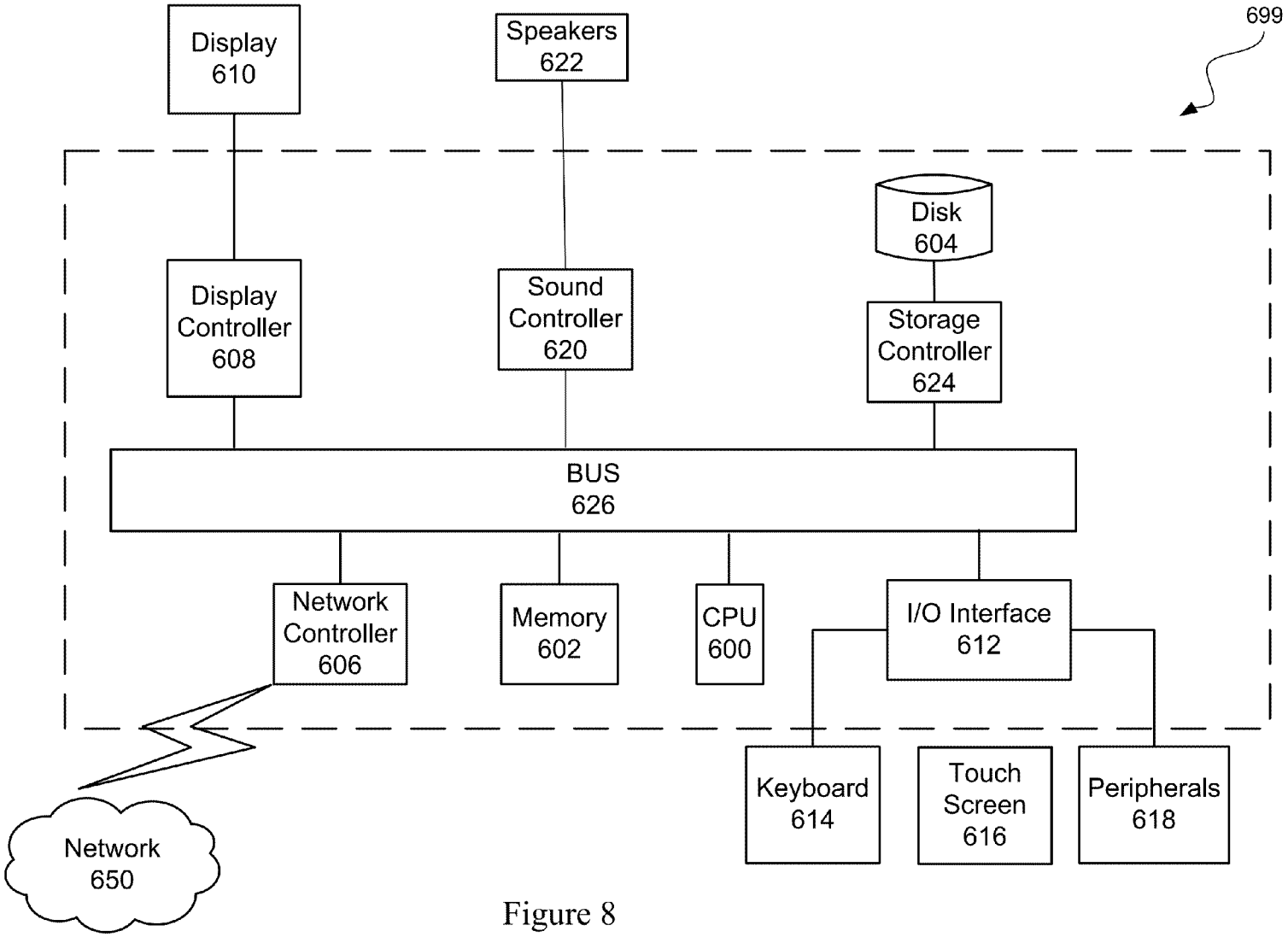
FIG. 8 illustrates a computer system upon which an embodiment of the present disclosure may be implemented.

Each of the functions of the above described embodiments may be implemented by circuitry, which includes one or more processing circuits. A processing circuit includes a particularly programmed processor, for example, processor (CPU) 600, as shown in FIG. 8. A processing circuit also includes devices such as an application specific integrated circuit (ASIC) and conventional circuit components arranged to perform the recited functions.

In FIG. 8, the device 699 includes a CPU 600 which performs the processes described above. The device 699 may be a general-purpose computer or a particular, special-purpose machine. In one embodiment, the device 699 becomes a particular, special-purpose machine when the processor 600 is programmed to perform musical composition(s).

The process data and instructions may be stored in memory 602. These processes and instructions may also be stored on a storage medium disk 604 such as a hard drive (HDD) or portable storage medium or may be stored remotely. The instructions may be stored on CDs, DVDs, in FLASH memory, RAM, ROM, PROM, EPROM, EEPROM, hard disk or any other device with which the system communicates, such as a server or computer.

Further, the discussed embodiments may be provided as a utility application, background daemon, or component of an operating system, or combination thereof, executing in conjunction with CPU 600 and an operating system such as, but not limited to, Microsoft Windows, UNIX, Solaris, LINUX, Android, Apple MAC-OS, Apple iOS and other systems known to those skilled in the art.

CPU 600 may be any type of processor that would be recognized by one of ordinary skill in the art. For example, CPU 600 may be a Xenon or Core processor from Intel of America or an Opteron processor from AMD of America. CPU 600 may be a processor having ARM architecture or any other type of architecture. CPU 600 may be any processor found in a mobile device (for example, cellular/smart phones, tablets, personal digital assistants (PDAs), or the like). CPU 600 may also be any processor found in musical instruments (for example, a musical keyboard or the like).

Additionally or alternatively, the CPU 600 may be implemented on an FPGA, ASIC, PLD or using discrete logic circuits, as one of ordinary skill in the art would recognize. Further, CPU 600 may be implemented as multiple processors cooperatively working in parallel to perform the instructions of the processes described herein.

The computer 699 in FIG. 8 also includes a network controller 606, such as, but not limited to, a network interface card, for interfacing with network 650. As can be appreciated, the network 650 can be a public network, such as, but not limited to, the Internet, or a private network such as an LAN or WAN network, or any combination thereof and can also include PSTN or ISDN sub-networks. The network 650 can also be wired, such as an Ethernet network, or can be wireless such as a cellular network including EDGE, 3G and 4G wireless cellular systems. The wireless network can also be WiFi, Bluetooth, or any other wireless form of communication that is known.

The computer 699 further includes a display controller 608, such as, but not limited to, a graphics adaptor for interfacing with display 610, such as, but not limited to, an LCD monitor. A general purpose I/O interface 612 interfaces with a keyboard and/or mouse 614 as well as a touch screen panel 616 on or separate from display 610. General purpose I/O interface also connects to a variety of peripherals 618 including printers and scanners. The peripheral elements discussed herein may be embodied by the peripherals 618 in the exemplary embodiments.

A sound controller 620 may also be provided in the computer 699 to interface with speakers/microphone 622 thereby providing sounds and/or music. The speakers/microphone 622 can also be used to accept dictated words as commands.

The general purpose storage controller 624 connects the storage medium disk 604 with communication bus 626, which may be an ISA, EISA, VESA, PCI, or similar. A description of the general features and functionality of the display 610, keyboard and/or mouse 614, as well as the display controller 608, storage controller 624, network controller 606, sound controller 620, and general purpose I/O interface 612 is omitted herein for brevity as these features are known.

Obviously, numerous modifications and variations of the present disclosure are possible in light of the above teachings. It is therefore to be understood that within the scope of the appended claims, the invention may be practiced otherwise than as specifically described herein.

For example, advantageous results may be achieved if the steps of the disclosed techniques were performed in a different sequence, if components in the disclosed systems were combined in a different manner, or if the components were replaced or supplemented by other components.

The functions, processes, and algorithms described herein may be performed in hardware or software executed by hardware, including computer processors and/or programmable processing circuits configured to execute program code and/or computer instructions to execute the functions, processes, and algorithms described herein.

The functions and features described herein may also be executed by various distributed components of a system. For example, one or more processors may execute these system functions, wherein the processors are distributed across multiple components communicating in a network. The distributed components may include one or more client and/or server machines, in addition to various human interface and/or communication devices (e.g., display monitors, cellular/smart phones, tablets, PDAs). The network may be a private network, such as a LAN or WAN, or may be a public network, such as the Internet. Input to the system may be received via direct user input and/or received remotely either in real-time or as a batch process.

Additionally, some implementations may be performed on modules or hardware not identical to those described. Accordingly, other implementations are within the scope that may be claimed.

It should be noted that, as used in the specification and the appended claims, the singular forms "a," "an," and "the" include plural referents unless the context clearly dictates otherwise.

The invention claimed is:

1. A method for musical rhythmic composition, the method comprising:

receiving a selection of a rhythmic template out of a plurality of available rhythmic templates, each of the plurality of rhythmic templates being a pattern representing a musical genre;

displaying, on a display device, an irregular musical grid generated based on the selected rhythmic template to match the selected rhythmic template, the irregular grid including a plurality of blocks arranged side by side, at least one block of the plurality of blocks being irregularly spaced with respect to other blocks, each of the plurality of blocks representing a particular position at which a musical note is insertable to be in-rhythm with the corresponding musical genre of the selected rhythmic template;

receiving a designation of a block of the plurality of blocks in which to insert a musical note;

displaying a visual representation of the musical note in the designated block; and generating an indication that a musical note is out of rhythm, in response to designating an area in between two adjacent blocks of the plurality of blocks in which to insert the musical note.

2. The method according to claim 1, further comprising:

displaying, on the display device, a visual indication on the irregular musical grid distinguishing important parts of the selected rhythmic template from less important parts.

3. The method according to claim 1, further comprising:

receiving the musical note from an external musical instrument.

4. The method according to claim 1, further comprising:

displaying, on the display device, a warning that a musical note is out of rhythm, in response to designating an area in between two adjacent blocks of the plurality of blocks in which to insert the musical note.

5. The method according to claim 1, wherein the irregular grid includes a plurality of blocks irregularly spaced with respect to other blocks.

6. An apparatus for musical rhythmic composition, the apparatus comprising:

processing circuitry programmed to implement the musical rhythmic composition, the processing circuitry being configured to receive a selection of a rhythmic template out of a plurality of available rhythmic templates, each of the plurality of rhythmic templates being a pattern representing a musical genre, display an irregular grid generated based on the selected rhythmic template to match the selected rhythmic template, the irregular grid including a plurality of blocks arranged side by side, at least one block of the plurality of blocks being irregularly spaced with respect to other blocks, each of the plurality of blocks representing a particular position at which a musical note is insertable to be in-rhythm with the corresponding musical genre of the selected rhythmic template, receive a designation of a block of the plurality of blocks in which to insert a musical note, display a visual representation of the musical note in the designated block, and generate an indication that a musical note is out of rhythm, in response to designating an area in between two adjacent blocks of the plurality of blocks in which to insert the musical note.

7. The apparatus according to claim 6, wherein the processing circuitry is further configured to display a visual indication on the irregular musical grid distinguishing important parts of the selected rhythmic template from less important parts.

8. The apparatus according to claim 6, wherein the processing circuitry is further configured to receive the musical note from an external musical instrument.

9. The apparatus according to claim 6, wherein the processing circuitry is further configured to display a warning that a musical note is out of rhythm, in response to designating an area in between two adjacent blocks of the plurality of blocks in which to insert the musical note.

10. The apparatus according to claim 6, wherein the irregular grid includes a plurality of blocks irregularly spaced with respect to other blocks.

11. A non-transitory computer-readable storage medium including computer executable instructions, wherein the instructions, when executed by a computer, cause the computer to perform a method for rhythmic composition of a melody, the method comprising:

receiving a selection of a rhythmic template out of a plurality of available rhythmic templates, each of the plurality of rhythmic templates being a pattern representing a musical genre;

displaying, on a display device, an irregular musical grid generated based on the selected rhythmic template to match the selected rhythmic template, the irregular grid including a plurality of blocks arranged side by side, at least one block of the plurality of blocks being irregularly spaced with respect to other blocks, each of the plurality of blocks representing a particular position at which a musical note is insertable to be in-rhythm with the corresponding musical genre of the selected rhythmic template;

receiving a designation of a block of the plurality of blocks in which to insert a musical note;

displaying a visual representation of the musical note in the designated block; and generating an indication that a musical note is out of rhythm, in response to designating an area in between two adjacent blocks of the plurality of blocks in which to insert the musical note.

12. The non-transitory computer-readable storage medium according to claim 11, further comprising:

displaying, on the display device, a visual indication on the irregular musical grid distinguishing important parts of the selected rhythmic template from less important parts.

13. The non-transitory computer-readable storage medium according to claim 11, further comprising:

receiving the musical note from an external musical instrument.

14. The non-transitory computer-readable storage medium according to claim 11, further comprising:

displaying, on the display device, a warning that a musical note is out of rhythm, in response to designating an area in between two adjacent blocks of the plurality of blocks in which to insert the musical note.

15. The non-transitory computer-readable storage medium according to claim 11, wherein the irregular grid includes a plurality of blocks irregularly spaced with respect to other blocks.

16. The method according to claim 1, further comprising:

automatically affixing a musical note to the irregular grid, in response to an input.

17. A method for musical rhythmic composition, the method comprising:

receiving a selection of a rhythmic template out of a plurality of available rhythmic templates, each of the plurality of rhythmic templates corresponding to a musical genre;

generating an irregular musical grid corresponding to the selected rhythmic template, the irregular grid including a plurality of blocks arranged side by side, at least one block of the plurality of blocks being irregularly spaced with respect to other blocks, each of the plurality of blocks representing a particular position at which a musical note is insertable to be in-rhythm with the corresponding musical genre of the selected rhythmic template;

designating a block of the plurality of blocks in which to insert a musical note;

generating a representation of the musical note to be inserted in the designated block; and generating an indication that a musical note is out of rhythm, in response to designation of an area in between two adjacent blocks of the plurality of blocks in which to insert the musical note.

* * * * *